US005123184A

United States Patent [19]

Ferreira

[11] Patent Number: 5,123,184

[45] Date of Patent: Jun. 23, 1992

[54] REMOVABLE SHOE SPIKE LOCKABLE TO CONFIGURED SOLE PLATE

[76] Inventor: Joseph J. Ferreira, 595 Pleasant St., Raynham, Mass. 02767

[21] Appl. No.: 124,145

[22] Filed: Nov. 23, 1987

[51] Int. Cl.[5] ..... A43B 5/00; A43C 15/16

[52] U.S. Cl. ..... 36/134; 36/67 D

[58] Field of Search ..... 36/134, 127, 128, 67 R, 36/67 A, 67 D, 65

[56] References Cited

U.S. PATENT DOCUMENTS

| | | | |
|---|---|---|---|
| 1,768,426 | 6/1930 | Stelzer | 36/67 D |
| 2,223,794 | 12/1940 | Pierce et al. | 36/670 |
| 2,276,887 | 3/1942 | Smith | 36/59 R |
| 2,292,299 | 8/1942 | Smith | 36/67 D |
| 2,774,151 | 12/1956 | Dahlquist et al. | 36/67 D |
| 2,784,503 | 3/1957 | Anderson | 36/127 |
| 3,328,901 | 7/1967 | Strickland | 36/134 |
| 4,587,748 | 5/1986 | Collins | 36/127 |
| 4,648,187 | 3/1987 | Dassler et al. | 36/134 |
| 4,723,366 | 2/1988 | Hagger | 36/134 |

*Primary Examiner*—Steven N. Meyers
*Attorney, Agent, or Firm*—Oldham & Oldham Co.

[57] ABSTRACT

A spike shoe construction including a socket carrying ribbed insert mounted on and spaced from an outer sole with each socket carrying reusable lock means for locking spikes installed in the socket. Each spike in turn carries a lock means which is non-reusable in that it is so distorted or broken when removed to render it inoperative.

5 Claims, 2 Drawing Sheets

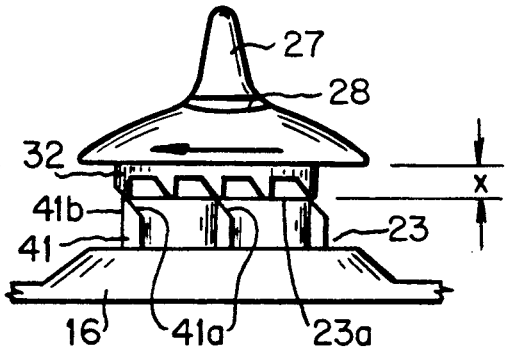
FIG. 4
FIG. 5
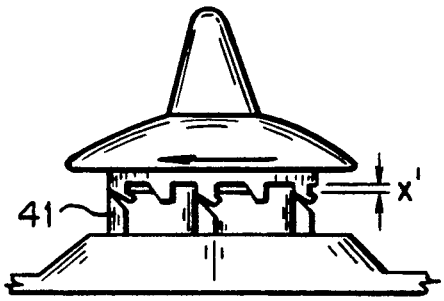
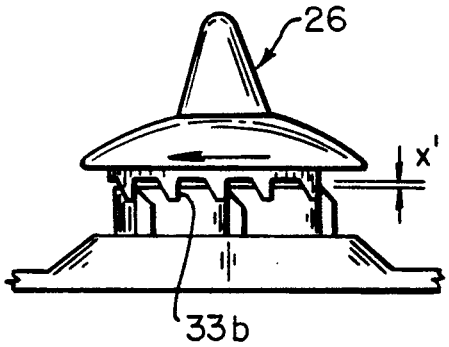
FIG. 6
FIG. 7
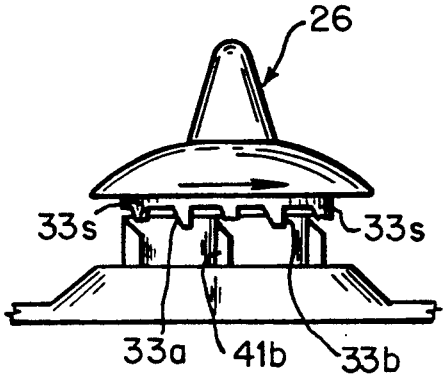

REMOVABLE SHOE SPIKE LOCKABLE TO CONFIGURED SOLE PLATE

BACKGROUND OF THE INVENTION

Plastic spikes for golf and other spiked shoes have been in use for a number of years (See U.S. Pat. No. 4,587,748). Sole inserts made of plastic for supporting spikes have also been used.

Sole insert and spike systems as structural components in shoe construction, as well as having the capacity of holding plastic spikes in position during service have included a number of drawbacks.

SUMMARY OF THE INVENTION

Briefly, the present invention is a shoe sole construction including a configured lightweight socket bearing insert having reinforcing means around the sockets and strengthening ribs between the sockets. Spikes are installed into the sockets using locking means on both the sockets and the spikes which locking means on the spike are deformable or frangible or both to allow removal of the spike after it has been installed in lock position.

It is a feature of the invention that inserts, spikes and sockets are made of plastic for lightweight, flexibility and deformability.

BRIEF DESCRIPTION OF THE INVENTION

FIG. 4 is an elevational view of a spike in the process of being initially positioned on the socket;

FIG. 5 is an elevational view of the spike having been rotated further with the spike locking tab being deflected by socket ribs;

FIG. 6 is an elevational view of the spike with the locking tabs having passed the socket ribs; and FIG. 7 is an elevational view of the spike having been rotated in the opposite direction for removal with locking tabs sheared.

DESCRIPTION OF THE PREFERRED EMBODIMENT

Figure 1:
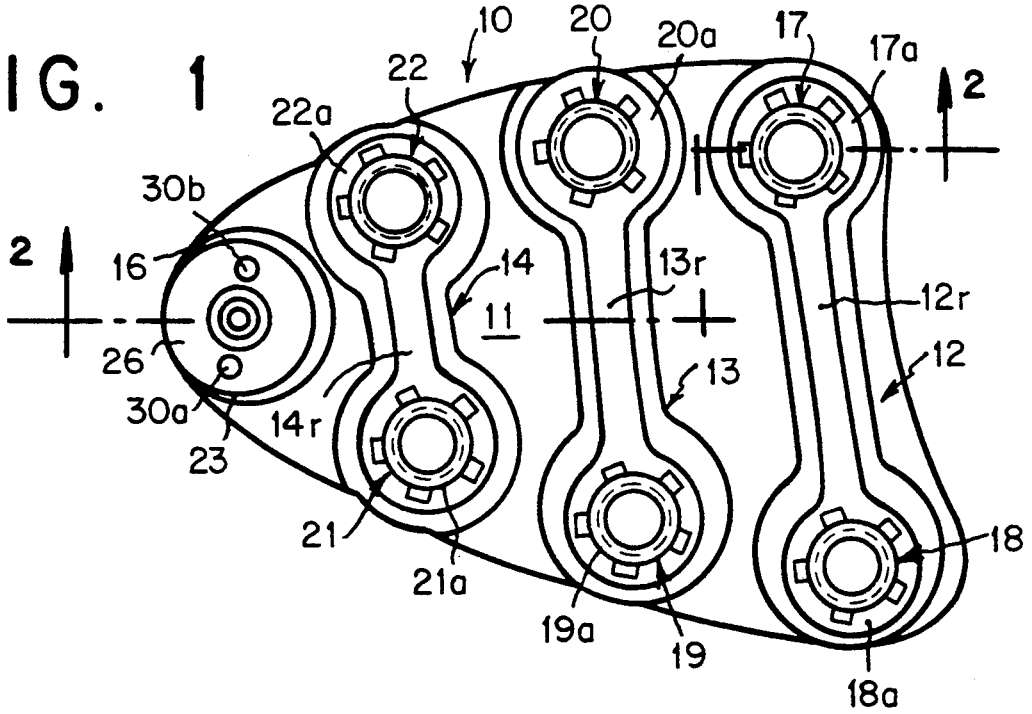
FIG. 1 is a plan view of a sole plate insert having spike-receiving sockets with one spike installed.
Figure 2:
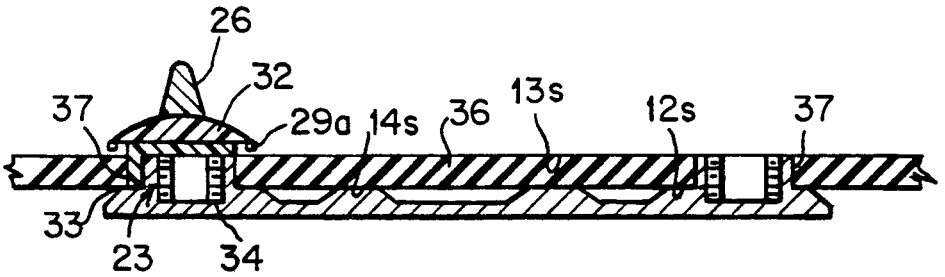
FIG. 2 is a section taken along line 2—2 of FIG. 1 with a portion of the outer shoe sole positioned adjacent the plate insert.
Figure 3:
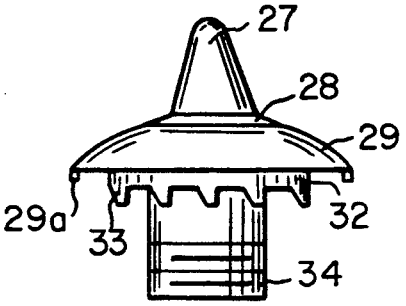
FIG. 3 is an elevational view of a pike.

Referring to FIGS. 1-3, molded plastic shoe insert 10 includes thin body 11, three (3) dumbbell-shaped rib portions 12, 13 and 14, and circular raised portion 16. Formed as part of the rib portions 12, 13, 14 are threaded sockets 17, 18, 19, 20, 21, 22 and 23. Rib portions 12, 13, and 14 have generally circular reinforcing elements 17*a*, 18*a*, 19*a*, 20*a*, 21*a*, and 22*a* positioned around the respective sockets. Rib portions 12, 13, and 14 also include rib crosspieces 12*b*, 13*b* and 14*b*. Also shown is shoe spike-carrying unit 26 including metal spike pin 27 with metal base 28 and plastic cap 29. Plastic cap 29 has two (2) wrench-receiving holes 30*a*, 30*b* for receiving a tool to screw spike 26 in to install for use and screw it out for removal and replacement.

Turning in particular to FIGS. 1 and 2, the dumbbell rib construction of sole plate 10 permits plate body 11 to be made thinner than a sole without such construction. The present construction provides for a lighter weight and more flexible sole plate. Ribs 12, 13 and 14 also provide spaced-apart support surfaces for a rubber, leather (or other material) outer shoe sole 36 (FIG. 2).

The spacing between outer sole socket receiving holes 37 permits relative movement between sole 36 and insert 10. Such relative movement is accomplished with less required forces as compared with a flat non-rib insert plate surface thus providing more flexibility to sole construction.

Turning to FIG. 4, spike 26 is shown in its initial step of being screwed into socket 23. Socket 23 which extends upwardly from circular raised portion 16 includes spaced-apart upstanding socket side projections 41 having slanted upper cam surfaces 41*a* and vertical non-cam surfaces 41*b*. Spike element 26 carries circular skirt 32 with flexible frangible lock tongues 33 depending in spaced manner from skirt 32. The original shape of lock tongue 33 includes cam surface 33*a* and vertical non-cam surface 33*b*. When spike 26 is initially being screwed into socket 23 skirt 28 and the top rim 23*a* of socket 23 are spaced apart. In FIG. 4, as spike 26 is screwed on in the direction of the arrow, lock tongues 33 just clear upstanding side rib 41. In FIG. 5 after spike 26 has been screwed on further and spike skirt 32 is just above the upper rim 23*a* of socket 23, lock tongues 33 are forced to be deformed by camming action of upstanding projection cam surfaces 41*a*. With further turning the lock tongues 33 pass the ribs 41 and restore themselves to some extent to their original shape (FIG. 6). Spike 26 is turned until skirt 32 engages socket upper rim 23*a* or until the spike 26 is otherwise tightly held in place. Each expendable tongue 33 will in this installation process pass against, be deformed by, and pass by a number of socket projections 41 a distance X, from rim 23*a*. The interference between projections 41 and tongues 33 as spike 26 is urged to be turned holds spike 26 in place during shoe use.

When replacement of spike 26 is desired, a wrench is used to turn the spike in the opposite direction (arrow of FIG. 6). Since the tongue vertical side 33*b* is presented to the vertical non-cam side 41*b* of the projection 41, a portion of tongue 33 will shear off leaving tongue stump 33*s* which stump 33*s* can clear the projections 41 and permit removal of the spike 26.

It is also contemplated that the depending tongues may be made of selected materials and so shaped such that the tongues will undergo distortion as the spike is installed and when the spike is removed will undergo additional distortion without shearing or breaking.

I claim:

1. A shoe construction for shoes with removable spikes comprising a. an outer sole with a plurality of spaced-apart socket-receiving holes;

b. a thin sole insert carrying spike sockets for positioning in such sole holes; reinforcing circular portions around the sockets and in engagement with the outer sole with each socket having a rim lying in a plane substantially parallel to the outer sole;

c. spike elements positioned in the sockets by thread means with turning of the spike elements in a first direction causing the elements to be screws into their sockets and turning in the opposite direction to remove the elements, each spike element having a bendable first non-reusable lock means thereon;

d. second reusable non-bendable lock means on the spike sockets, both first and second lock means sized and shaped so that the forces to overcome interference and thereby to screw the spike elements in the first direction into the sockets is less than the forces required to remove the elements as the elements are screwed in the second direction and so that the first lock means is not sheared, broken or otherwise spent upon engagement with the second lock means but the first lock means is sheared, broken or spent as it is disengaged from the second lock means as the spike element is so removed.

2. The shoe spike and socket arrangement of claim 1 in which the second lock means is a plurality of spaced-apart upstanding stationary rib projection means having a first projection side substantially transverse to the plane of the socket rim and a second projection cam side at an angle to the plane of the socket rim and the first lock means is a plurality of movable tongues means depending from the spike element skirt body having a first tongue side substantially transverse to the plane of the socket rim and a second tongue cam side at an angle to the plane of the socket rim so that as the spike element is secured into the socket the angled sides engage and as the element is removed the substantially transverse sides engage.

3. The shoe spike and socket arrangement of claim 3 in which the first lock means has cam means and non-cam means thereon to permit the second lock means to pass the first lock means with a first resistance as the spike element is installed and to permit the second lock means to pass the first lock means during spike element removal which will create a second resistance which second resistance is greater than the first resistance.

4. In a shoe having a sole with socket-receiving holes, spikes, a lock spike system comprising a. a plurality of plastic sockets mounted in the said sole holes, each socket including an upper rim;

b. first non-bendable plastic lock means on the socket;

c. spike elements secured in said sockets using thread means;

d. second bendable and shearable plastic lock means on the spike elements;

e. each lock means in turn comprising i) cam means and non-cam means to permit the second lock means to bend and pass the first lock means with a first resistance as the spike element is installed and to permit the second lock means to shear as it passes the first lock means during spike element removal which will create a second resistance which second resistance is greater than the first resistance.

5. The spike system of claim 4 in which each socket has a generally cylindrical portion; a plurality of spaced-apart vertically disposed non-bendable plastic ribs, which comprise the first lock means. attached to or integrally formed with the periphery of the cylindrical portion, each rib extending the depth of the cylindrical portion and attached to or integrally formed with the cylindrical portion; said ribs having a vertical side throughout the length of the rib, and an inclined planar surface at one end of the rib; each spike element having a bendable. shearable plastic tongue, which comprises the second lock means having an inclined planar surface for engaging in series with said rib inclined planar surfaces as the tongue is moved around the socket cylindrical portion with the tongue bending and each of the ribs not bending; whereby (a) the tongue is placed alongside one of the ribs without breaking or shearing said tongue and (b) the tongue with its vertical side interferes with a vertical side of the last rib it passed while being turned in a first direction so that when the tongue is turned in a second opposite direction the tongue shears.

* * * * *

UNITED STATES PATENT AND TRADEMARK OFFICE

CERTIFICATE OF CORRECTION

PATENT NO. :5,123,184

DATED :June 23, 1992

INVENTOR(S) :Joseph J. Ferreira

It is certified that error appears in the above-indentified patent and that said Letters Patent is hereby corrected as shown below:

On the title page, item (76) Inventor's, should read --
Joseph J. Ferreira, 595 Pleasant Street, Raynham, Massachusetts 02767; and Roy S. Collins, Sutton Coldfiel, United Kingdom
--.

Signed and Sealed this

Ninth Day of November, 1993

Bruce Lehman

*Attest:*

BRUCE LEHMAN

*Attesting Officer*

*Commissioner of Patents and Trademarks*